US006050032A

United States Patent [19]

Yamada et al.

[11] Patent Number: 6,050,032

[45] Date of Patent: Apr. 18, 2000

[54] SAFETY FENCE FOR A HATCH FORMED IN A SLAB

[75] Inventors: Kenichi Yamada; Yukio Nakaya; Hiroto Nakagawa; Mituru Hori, all of Osaka, Japan

[73] Assignees: Anandenki Co., Ltd.; The Kansai Electric Power Co., Inc., both of Osaka, Japan

[21] Appl. No.: 09/158,532

[22] Filed: Sep. 22, 1998

[51] Int. Cl.[7] ..... E06B 11/02

[52] U.S. Cl. ..... 52/64; 52/69; 49/33; 49/118; 49/255

[58] Field of Search ..... 52/64, 69, 71, 52/79.5, 646; 256/24, 25, 26; 49/118, 119, 33, 254, 255

[56] References Cited

U.S. PATENT DOCUMENTS

| | | | |
|---|---|---|---|
| 79,141 | 6/1868 | McFarlin | 49/10 |
| 762,741 | 6/1904 | Moos | 49/33 X |
| 1,177,251 | 3/1916 | Kearney | 49/33 X |
| 1,688,074 | 10/1928 | Goff | 52/71 |
| 1,741,323 | 12/1929 | Lufkin | 52/71 X |
| 2,473,076 | 6/1949 | Scheibner | 52/71 X |
| 2,582,540 | 1/1952 | Gruse | 49/33 X |
| 3,094,710 | 6/1963 | Hoke | 49/33 X |
| 4,880,210 | 11/1989 | Cucksey | 52/71 X |
| 5,941,024 | 8/1999 | Journault | 52/64 X |

FOREIGN PATENT DOCUMENTS 5-57243 7/1993 Japan .

*Primary Examiner*—Beth A. Aubrey
*Assistant Examiner*—Brian E. Glessner
*Attorney, Agent, or Firm*—Wenderoth, Lind & Ponack, L.L.P.

[57] ABSTRACT

A safety fence for a square hatched formed in a slab of a building is provided. The fence has lids pivotable about opposed sides of the hatch, and has such a size that about half of the opening of the hatch is closed by each of the lids. Side frames having a predetermined height are pivotable about opposed sides of the hatch. A plurality of gear mechanisms is provided, with each mechanism comprising a first gear and a second gear in mesh with each other, a first shaft supporting the first gear, a second shaft supporting the second gear, the first and second shafts extending parallel to the opposed ends of the hatch, the first gears being secured to lower ends of the lids, and counterweights mounted to one of the second shafts. The safety fence is set up by erecting the lids and the side frames. A plurality of brackets each having a pair of bracket portions secured to the inner wall of the hatch. The pairs of bracket portions are provided on each side of each of the gear mechanisms and support the first and second shafts supporting the first and second gears.

14 Claims, 12 Drawing Sheets

SAFETY FENCE FOR A HATCH FORMED IN A SLAB

BACKGROUND OF THE INVENTION

This invention relates to a safety fence surrounding a hatch provided in a slab of a multi-story building.

In such multi-story buildings as power plants, hatches are provided in the slab of each floor, through which necessary equipment and materials are brought in and taken out. When not used, such hatches are closed by lids.

In order to bring in or take out a certain article, the lids covering the hatches are removed by an overhead crane installed on the rooftop; safety fences are set up around the now open hatches; and the intended article is brought in or taken out. The hatches are then closed and the fences are removed in reverse order.

For this operation, three men are needed, i.e., a crane operator and two additional men positioned near each hatch. The working time for each hatch by three men is about 25 minutes. In order to bring articles into or take them out of a lower floor, all the hatches above this floor have to be opened and then closed in the abovementioned manner. Work efficiency is thus extremely low.

When safety fences are set up around hatches with the hatches open, men or articles might fall into the hatches. Setting up of safety fences is time-consuming and troublesome. Thus, workers frequently omit setting up fences, knowing that this is dangerous.

In order to solve this problem, unexamined Japanese utility model publication 5-57243 proposes a hatch/safety fence structure comprising lids and side frames mounted on each hatch formed in a slab. In a normal state, the hatch is closed by the lids and the frames. When the lids and the frames are raised to open the hatch to bring in or take out articles, the lids and the frames are automatically assembled into a safety fence.

This safety fence has counterweights so that the lids can be easily erected. The counterweights are supported by shafts extending between the opposed sides of the hatch. Thus, the effective area usable when articles are brought in or taken out through the hatch is limited to the area defined between the shafts.

If the ceiling of the floor in which the hatches provided is low, it may be impossible to bring in or take out an article because the article cannot be lifted to a level higher than the top of the fence.

In addition, the fence prevents an operator from entering the hatch even if he has to.

Furthermore, in order to prevent men from falling into the hatch over the fence, the fence has to be at least about 110 cm high. But if the hatch is small, the safety fence, set up by erecting the lids and side frames of such a hatch may be lower than 110 cm.

An object of this invention is to provide a safety fence which permits effective use of the opening of the hatch, makes it possible to bring in and take out an article even if the ceiling is low, permits access into the hatch, and is high enough even if the hatch is small.

SUMMARY OF THE INVENTION

According to this invention, there is provided a safety fence for a square hatch formed in a slab of a building. The fence comprises lids that are pivotable about opposed ends of the hatch and have such a size that about half of the opening of the hatch is closed by each of the lids, side frames having a predetermined height and pivotable about opposed sides of the hatch, and a plurality of gear mechanisms, wherein each one of the gear mechanisms is provided near each of the opposed ends of the hatch. Each gear mechanism comprises a first gear and a second gear in mesh with each other, a first shaft supporting the first gears, and a second shaft supporting the second gear. The first and second shafts extend parallel to the opposed ends of the hatch, and the first gears are secured to lower ends of the lids. Counterweights are mounted to each of the second shafts, whereby the safety fence is set up by erecting the lids and the side frames. The fence further comprises a plurality of pairs of brackets secured to the inner wall of the hatch. Each of the plurality of brackets has a pair of bracket portions which are provided on respective sides of each of the gear mechanisms supports the first and second shafts which support the first and second gears.

The first shafts and the second shafts are provided between the bracket portions on both sides of the gears. There is no need to provide long shafts extending from one side to the other side of the hatch. In other words, the first shaft and second shaft for each of the gear mechanisms are discrete members, so there exists no shaft between the gears provided along each end line of the hatch. Thus, it is possible to use the entire area of the hatch except the portions where there are the gears.

Since the side frames on one side of the hatch are pivotable away from the hatch (i.e., toward the slab) an article can be brought in or taken out without first lifting it to a level higher than the safety fence.

Since at least one side frame is openable, a worker can enter the pit or hatch by opening the side frame.

Sub-frames and slide frames serve to increase the height of the lids and the side frames when erected. Thus, even if the hatch is small and thus the lids and the side frames themselves are short, it is possible to increase their height to a necessary level.

BRIEF DESCRIPTION OF THE DRAWINGS

Other features and objects of the present invention will become apparent from the following description made with reference to the accompanying drawings, in which.

DETAILED DESCRIPTION OF THE PREFERRED EMBODIMENT (First Embodiment)

Figure 1:
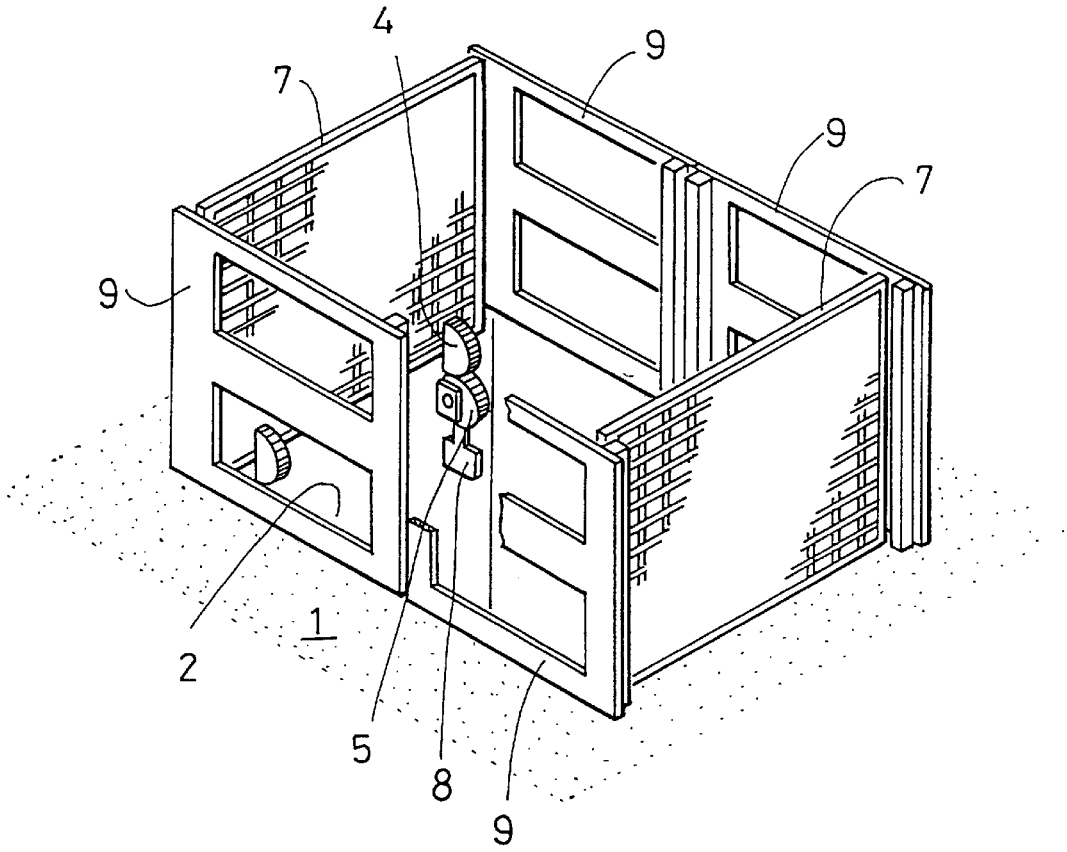
FIG. 1 is a schematic view showing a first embodiment of this invention.
Figure 2:
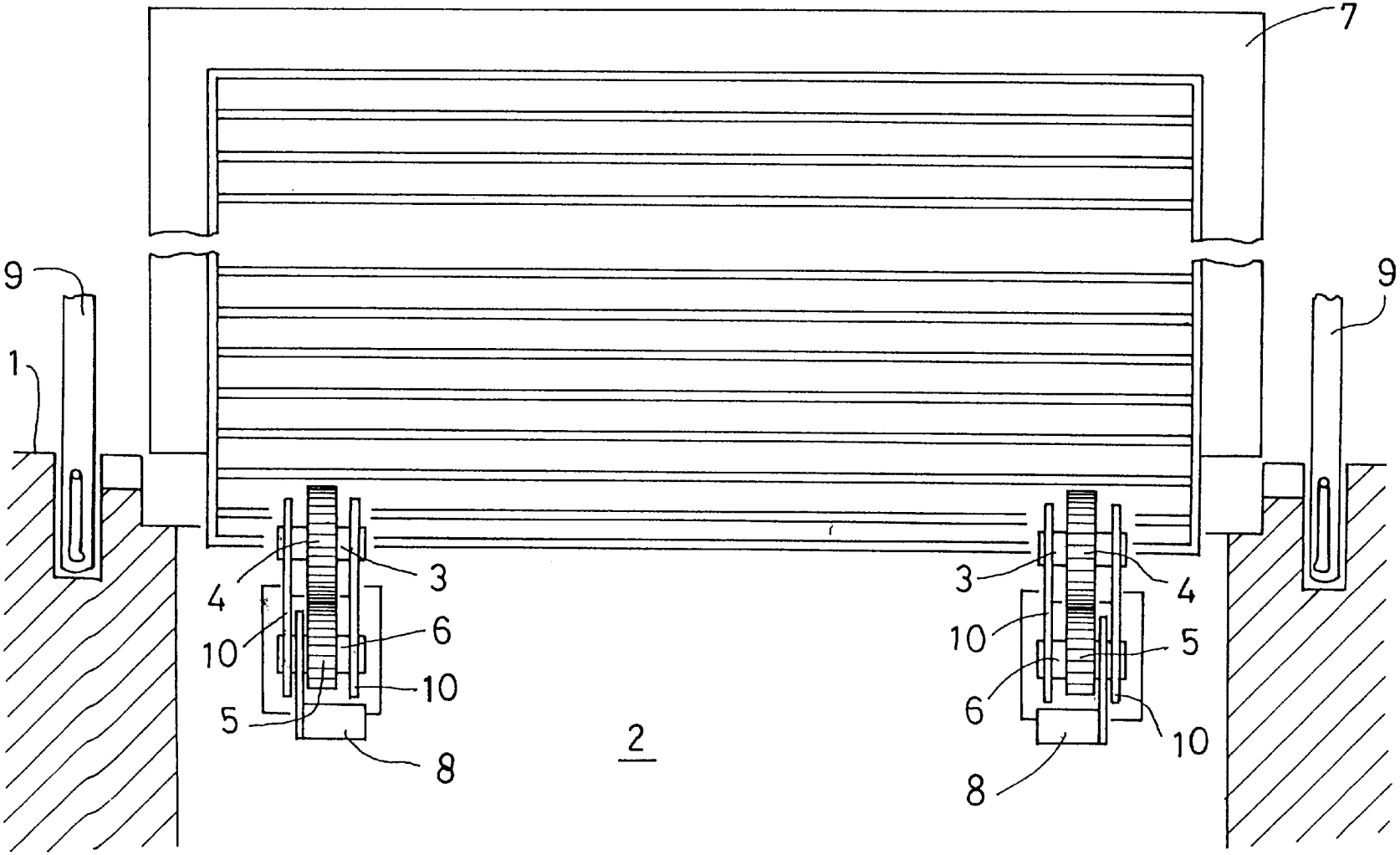
FIG. 2 is a partial enlarged front view of the same.

In the first embodiment shown in FIGS. 1–4, a square hatch 2 is formed in a slab 1 of a building. Lids 7 are mounted so as to be pivotable about a first pair of opposed sides of the hatch 2 between horizontal and erect (vertical) positions. In its horizontal position, each lid 7 covers half of the hatch 2. Side frames 9 are pivotable about a second pair of opposed sides of the hatch 2. When erected, the lids 7 and the side frames 9 form a safety fence as shown in FIG. 1. To close the hatch 2, the lids 7 are pivoted to the horizontal position and then the side frames 9 are folded onto the lids.

Figure 4:
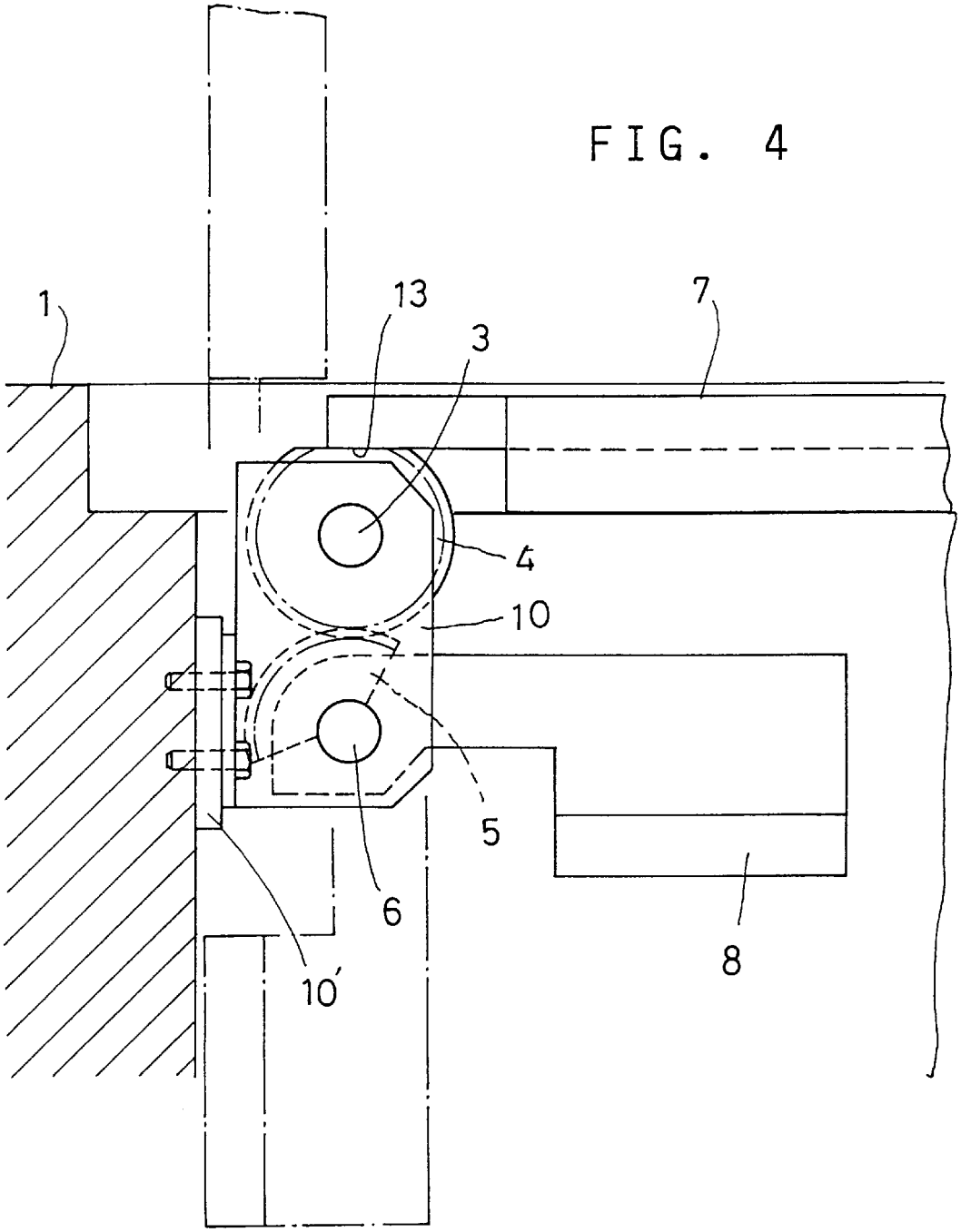
FIG. 4 is an enlarged sectional view showing a pair of gears.

Near the opposed ends of the hatch 2, gear mechanisms each having a gear 4 and a gear 5 in mesh with each other are provided. The gears 4 and 5 are supported by first and second shafts 3 and 6, respectively, which are in turn supported by brackets 10 comprising bracket portions at both sides of each of the gears 4, 5. As shown in FIG. 4, each bracket 10 is secured to the slab 1 through a bracket support 10' fixed to the slab wall.

As shown in FIG. 4, each gear 4 is fixed to a rear end portion of a lid 7 at its flat cut portion 13. Each gear 5 carries a counterweight 8. When pivoted toward the erect position, the lids 7 rotate the gears 4, which in turn rotate the gears 5, thus pivoting the counterweights 8 downwardly. This arrangement assures that the lids 7 can thus be smoothly pivoted up and down.

Figure 3:
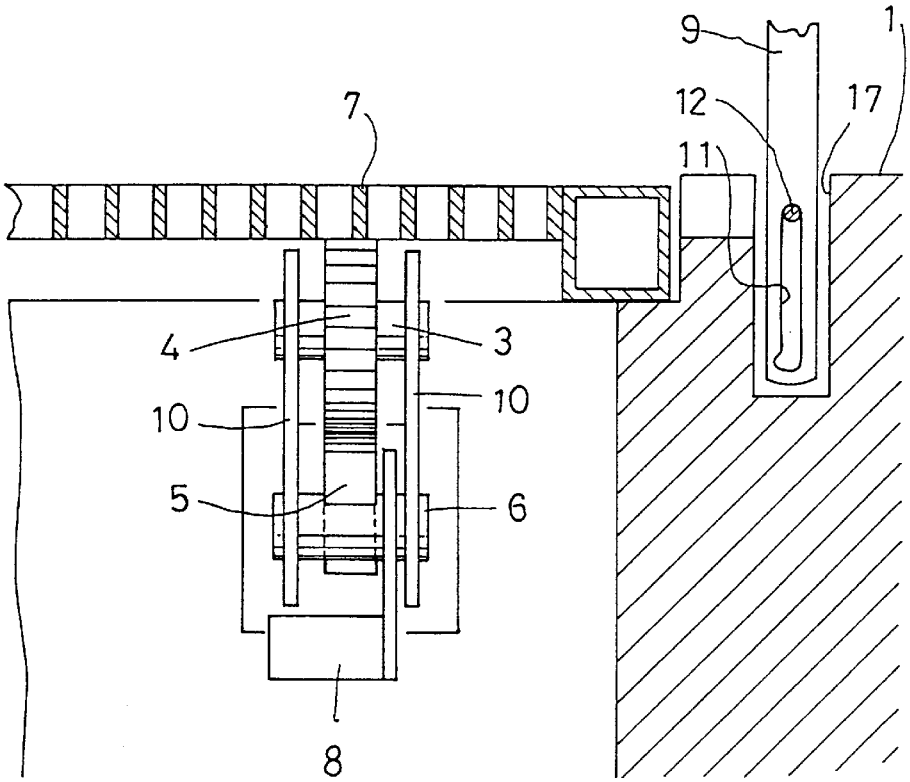
FIG. 3 is an enlarged front view of a portion of FIG. 2.

Referring now to FIG. 3, holes 17 are formed in the slab 1 along each of the second pair of opposed sides of the hatch 2. When the side frames 9 are erected into the vertical position, their bottom edges are retained in the holes 17. Each frame 9 is formed with an elongated hole 11 at one end into which a pin 12 is inserted. When each frame 9 is erected into the vertical position, the pin 12 is disposed at the top end (inner end) of the elongated hole 11, and when the frame 9 is tipped toward the hatch 2, the pin 12 is disposed at the bottom end (outer end) of the hole 11, thus preventing the frame 9 from coming off.

In the embodiment of FIG. 1, two such frames 9 are provided on each of the second pair of sides. But depending on the size of the hatch 2 and the trouble erecting the frames, a single frame 9 or more than two frames may be provided on either side. When erected, they have to be high enough to prevent any person from falling over the fence into the hatch. When tipped flat from both sides, the frames 9 may overlap with each other, though they have to be shorter than the width of the hatch. If overlapped, they should be shaped so that a smooth flat top surface is formed. Also, a gap may be formed between the opposing side frames 9 when they are pivoted to the flat position from both sides because the hatch is completely closed by the lids 7.

(Second Embodiment)

Figure 5:
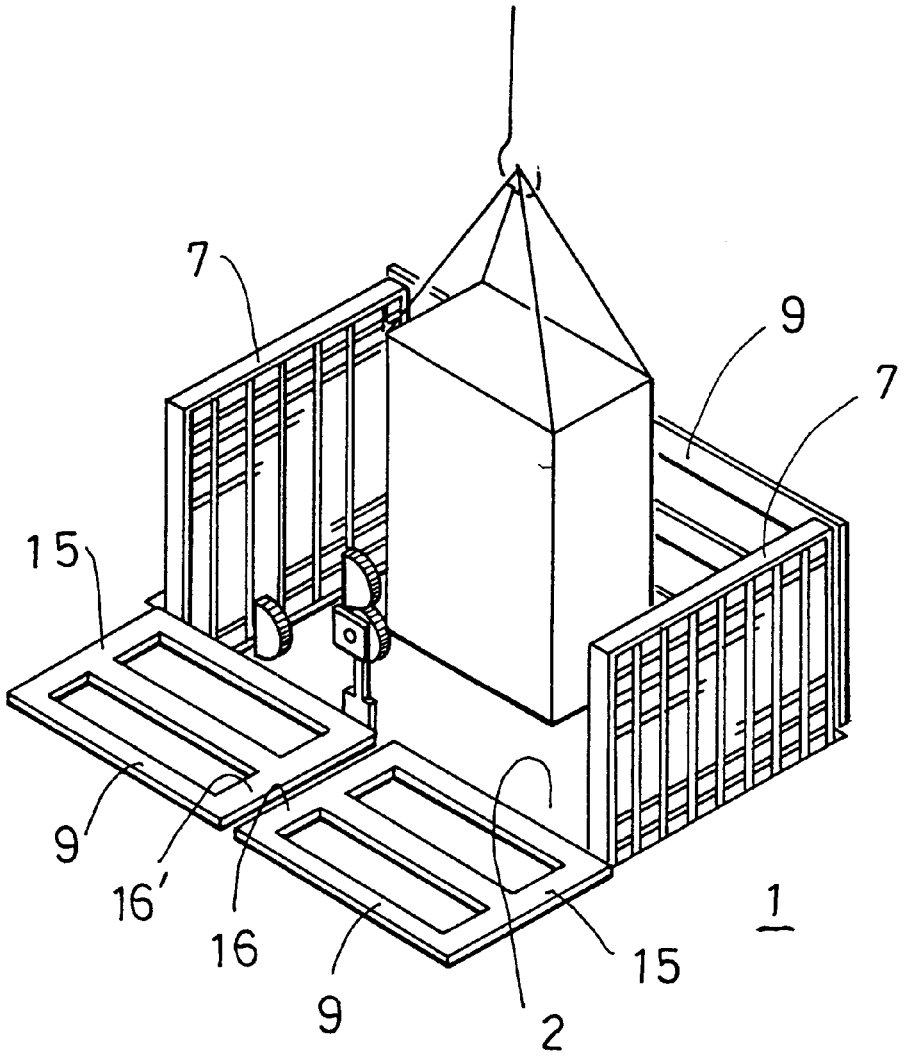
FIG. 5 is a schematic view of a second embodiment.
Figure 6:
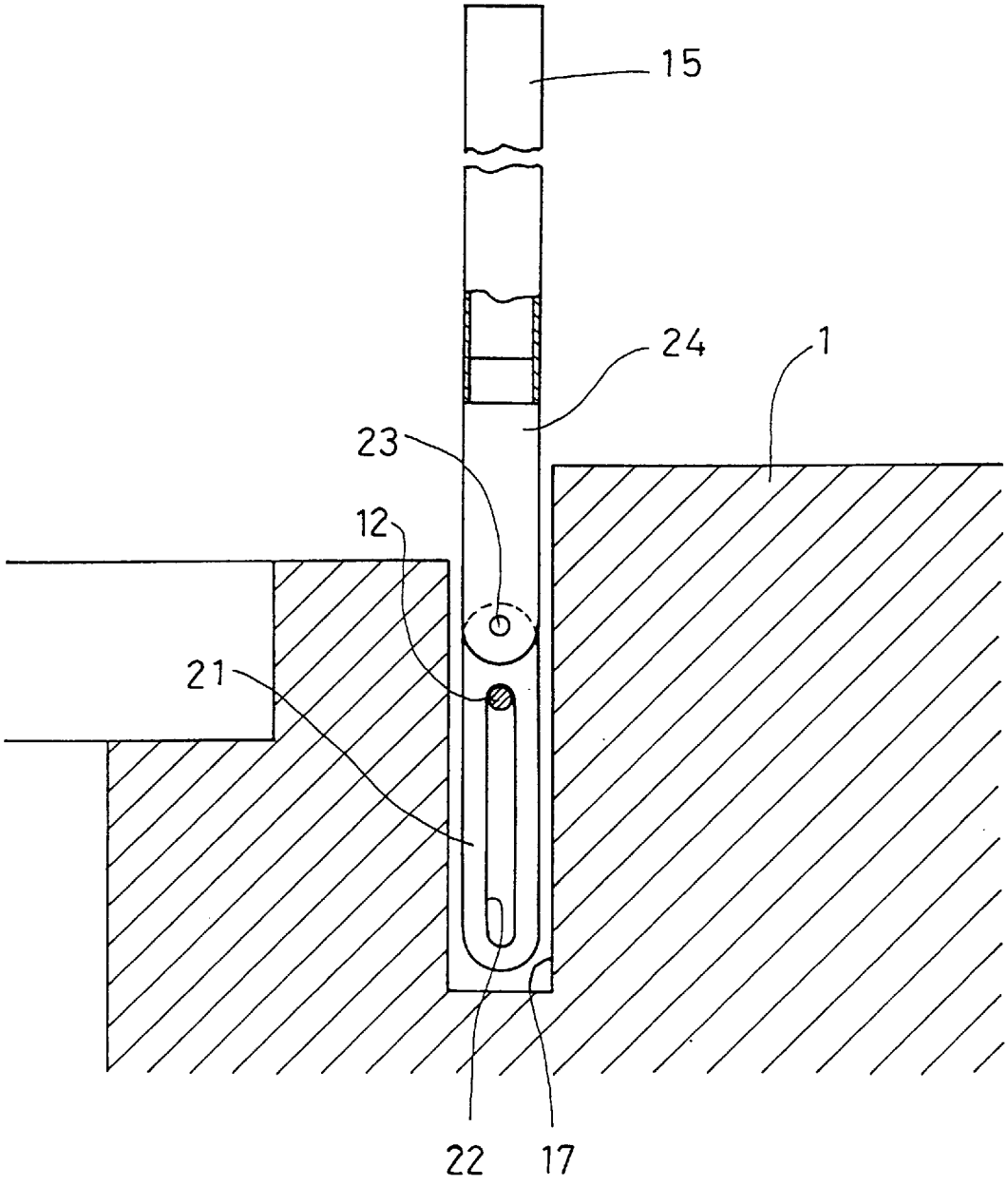
FIG. 6 is an enlarged sectional view of a support pole of a side frame of the second embodiment.

In the second embodiment shown in FIG. 5, the side frames 9 on one side are pivotable not only toward the hatch 2 but away from the hatch (i.e., toward the slab 1).

Each of the side frames 9 has extension 21 pivotably connected to the bottoms of the support poles 15, 16 of the frame 9 by pivot pins 23 and engaged in the hole 17. Each extension 21 has an elongated hole 22 in which a pin 12 is inserted. The holes 22 are longer than the holes 11 in the first embodiment. More particularly, the holes 22 are of such a length that when the pins 12 are disposed at the bottoms of the holes 22, the pivot pins 23 are located higher than the top surface of the slab 1 so that the frames can be pivoted toward the slab 1 about the pivot pins 23.

Figure 7B:
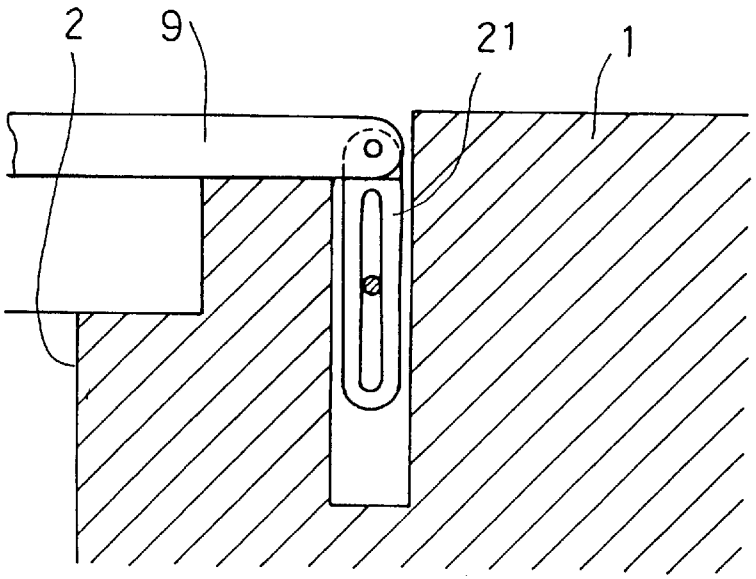
FIG. 7B is a sectional view of the side frame when pivoted toward the hatch.
Figure 7A:
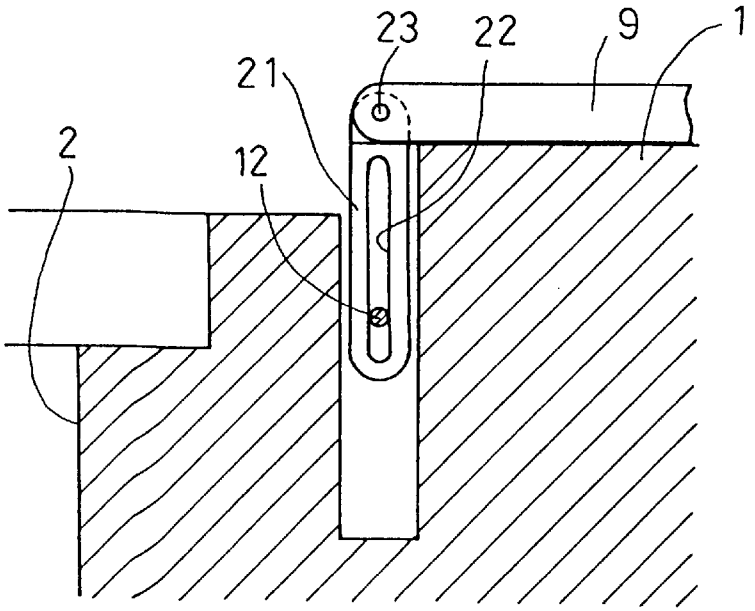
FIG. 7A is a sectional view of the side frame when pivoted toward the slab.

Thus, by raising each frame 9 to the height shown in FIG. 7B, it can be pivoted toward the hatch 2 about the pivot pins 23. By further raising each frame 9 to the height shown in FIG. 7A, it can now be pivoted toward the slab 1. The pins 12 remain engaged in the holes 22, preventing each frame from coming out of the hole 17.

If no sufficiently long holes 22 can be formed due, for example, to an insufficient length of the extension members 21, holes 22 having their bottoms open may be formed instead of the holes 22 with closed bottoms as shown. In this case, the pins 12 may come out of the holes 22. But as long as the extension members 21 are in the hole 17, the frames 9 will never come off. In this embodiment, the pins 12 are not essential components. If the pins 12 are omitted, the holes 22 with closed or open bottoms are not needed, either. In this case, as long as the extension members 21 remain engaged in the hole 17, the frames will never come off.

In other respects, this embodiment is the same both structurally and operationally as the first embodiment. Gears mounted to the lids and gear-supporting shafts may be ordinary ones or those used in the first embodiment.

(Third Embodiment)

Figure 8:
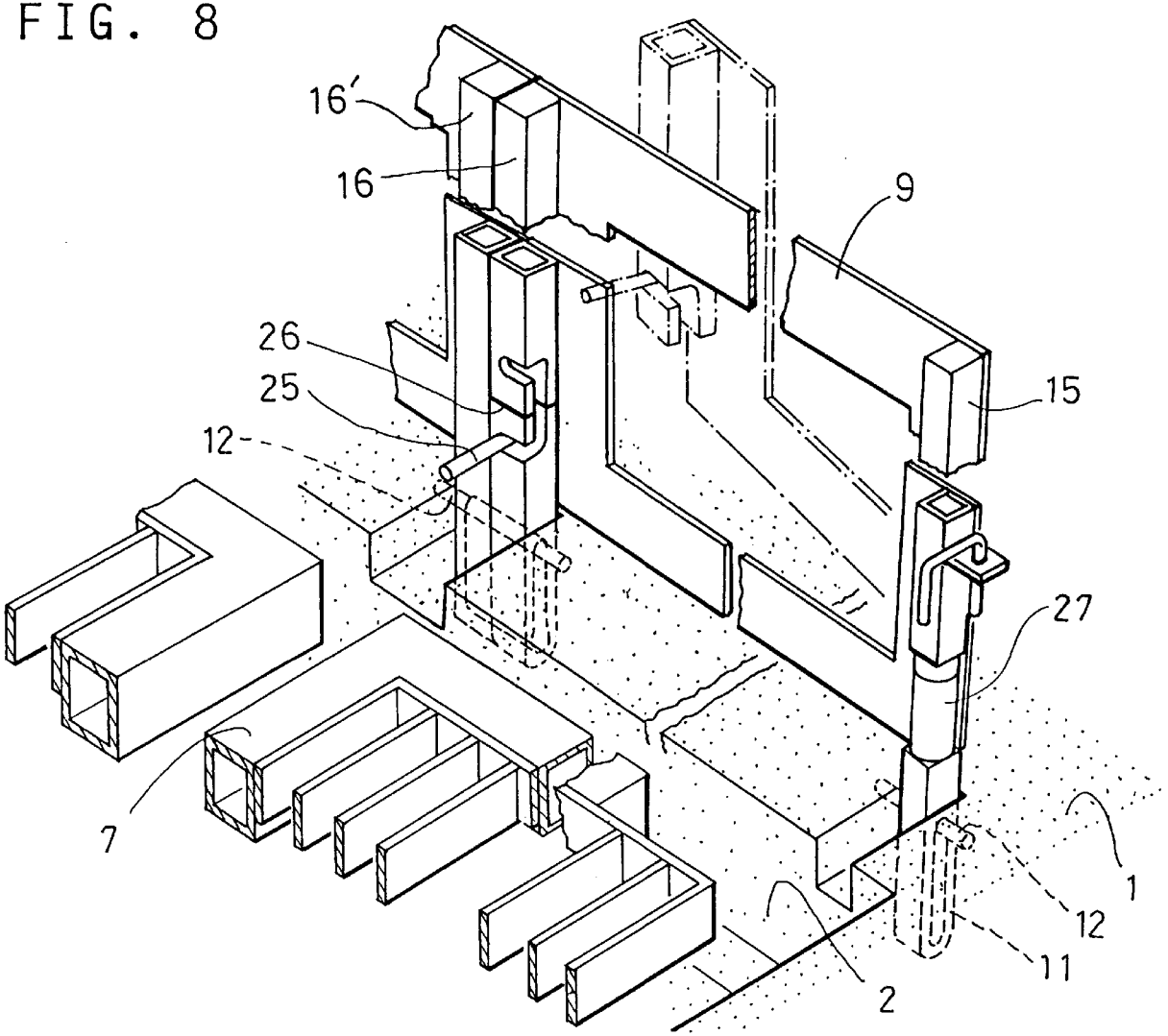
FIG. 8 is a schematic view of a third embodiment.
Figure 10:
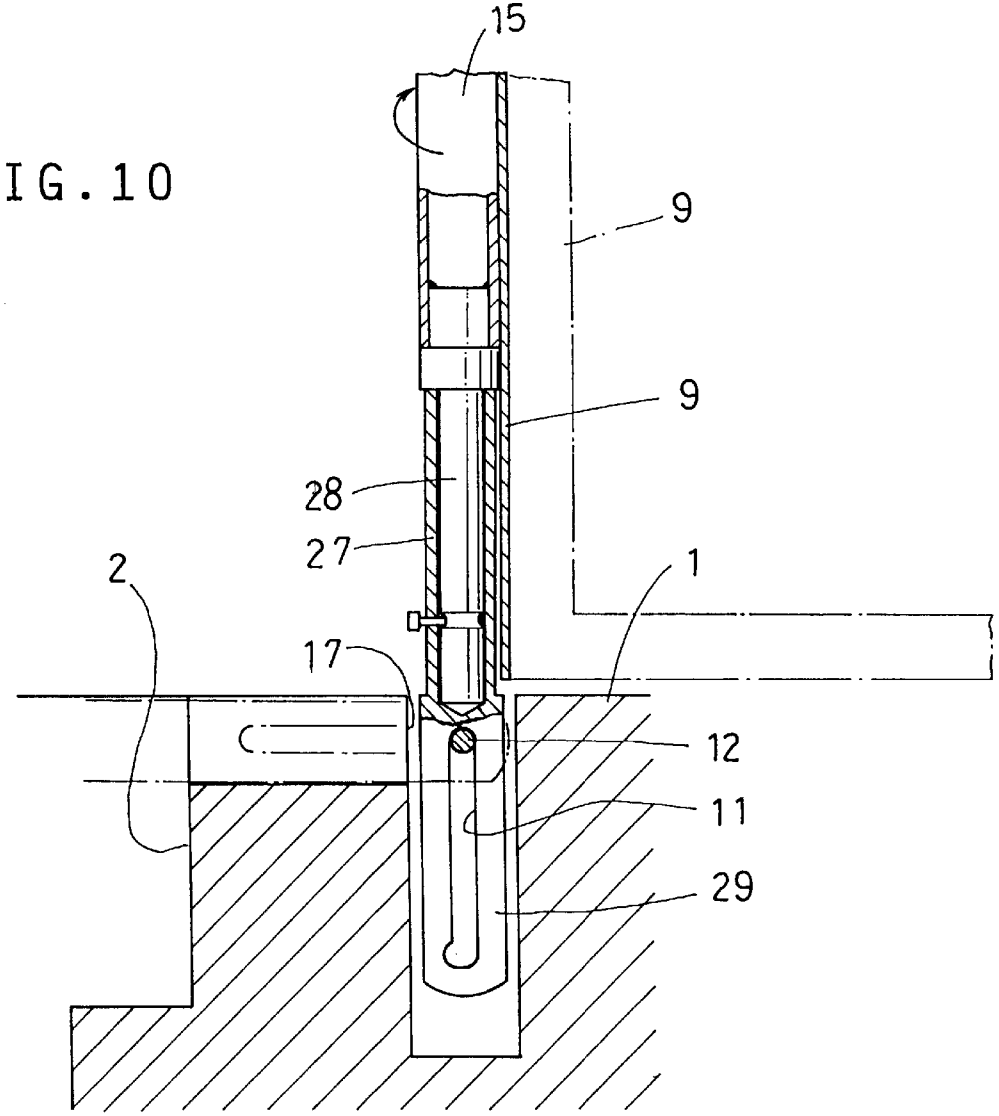
FIG. 10 is an enlarged sectional view of a support pole of the openable side frame of FIG. 8 at its end having a rotary shaft.

In the third embodiment shown in FIG. 8, one frame 9 is openable. The openable frame 9 has support poles 16 and 15. As shown in FIG. 10, the pole 15 comprises a swivel support pole including an upper pole portion which has a shaft 28 at its bottom. The shaft 28 rotatably fits in a sheath portion 27 of a lower pole portion 29 retained in the hole 17. Therefore, the rotary shaft 28 is rotatable independently of the lower pole portion 29.

Figure 9:
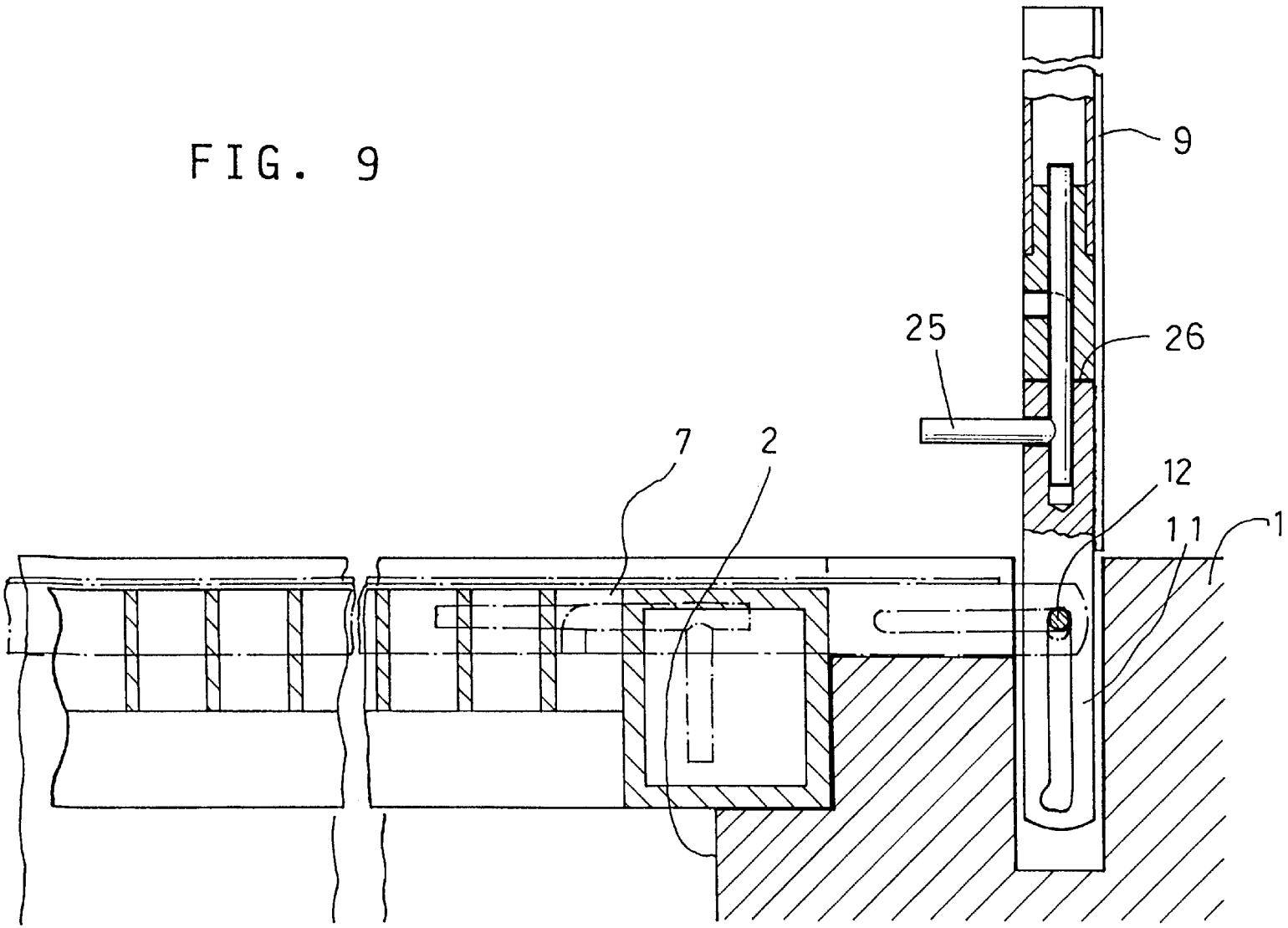
FIG. 9 is an enlarged sectional view of a support pole of the openable side frame of FIG. 8 at its free end.

As shown in FIGS. 8 and 9, the support pole 16 comprises a latch support pole and is in contact with the support pole 16' of the adjacent non-openable frame 9. The latch support pole 16 is split into a lower pole portion engaged in the hole 17 and an upper pole portion. The split is along a plane 26 which extends parallel to the slab 1 at a level higher than the top surface of the slab 1 when the frames 9 are erected into the upright position. The upper and lower portions are connected together by a connection pin 25 comprising a vertical bar portion movable vertically through the upper and lower portions, and a horizontal handle bar portion connected to a lower portion of the vertical bar portion. When the vertical bar portion is moved to the upper limit, its bottom is carried out of the lower portion of frame 9, so that the upper portion of frame 9 is disconnected from the lower portion of frame 9. The handle bar portion of connecting pin 25 is movable along a groove formed across the upper and lower portions and which has a shape similar to a Japanese character "ㅋ". With the pole 16 erected, the vertical bar portion of the pin 25 is retained in position when the handle bar portion is in either of the horizontal upper and lower arm portions of the ㅋ-shaped groove.

As shown in FIG. 9, when the handle bar portion of the pin 25 is in the lower arm portion of the groove, the vertical bar engages both the upper and lower portions of the support pole 16, so that the upper and lower portions are connected together. When the handle bar portion has been moved into the upper arm portion of the groove, the bottom of the vertical bar portion is removed from the lower portion, so that the upper portion is disconnected from the lower portion. Since the other support pole 15 is rotatable, the frame can now be opened.

In this embodiment, the lower portion of the support pole 16 of the openable frame 9 and the adjacent support pole 16' are separate members. But they may be integral. If a single openable frame 9 is provided on one side of the hatch 2, the support pole 16 may be a single integral member. If a support pole provided at a corner of the hatch is selected as the rotatable support pole 15, the support pole is coupled near its top end to the lid 7 by a coupling device. This is preferable because the rotary shaft stabilizes.

The structure of this embodiment (other than the structure specifically described above) is the same as in the first embodiment. Gears mounted to the lids 7 and gear-supporting shafts may be ordinary ones or those used in the first embodiment. If it is necessary to pivot frames 9 toward the slab 1, the support poles 15, 16 of the frames 9 used in the second embodiment may be used.

(Fourth Embodiment)

Figure 11:
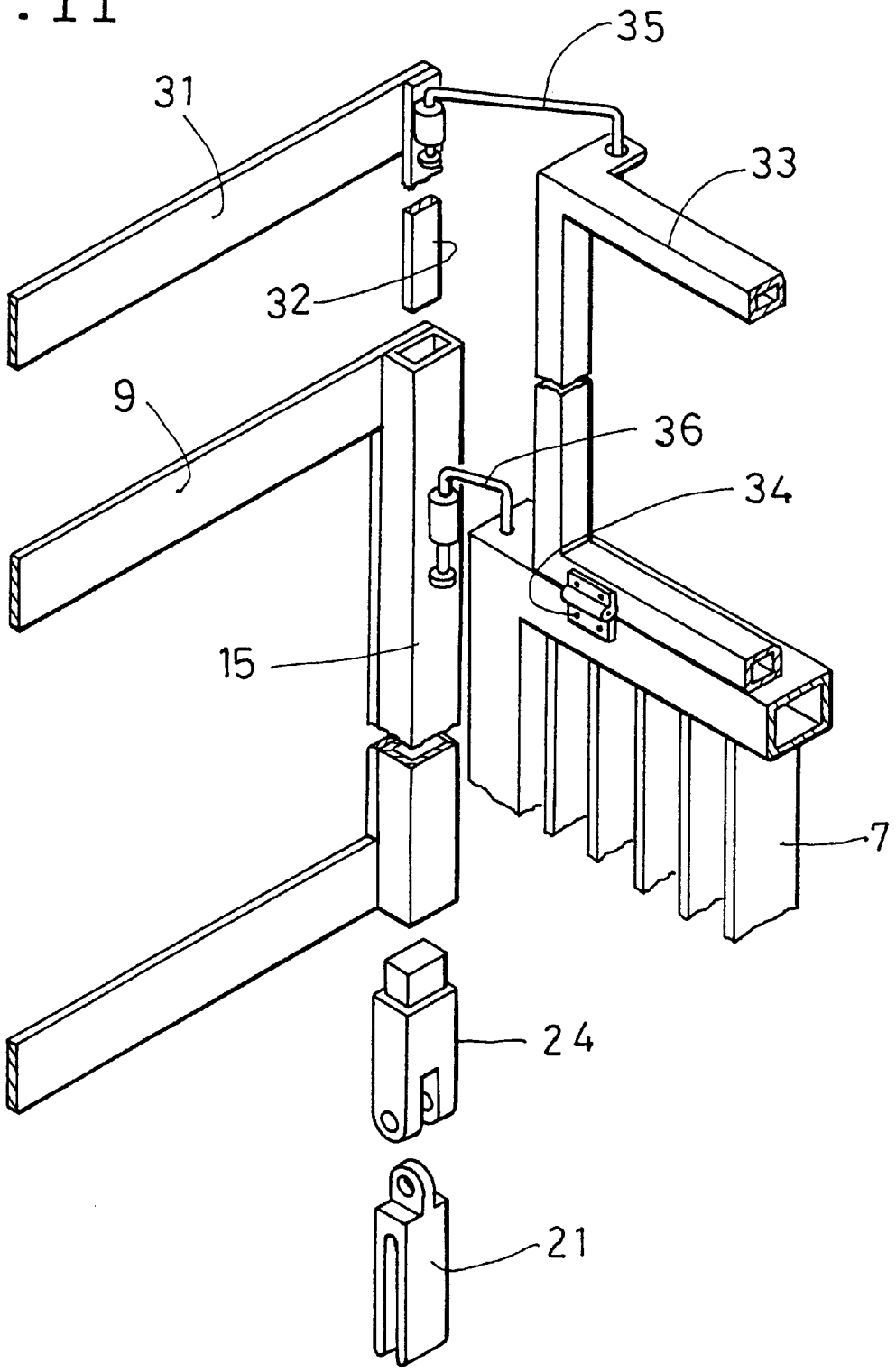
FIG. 11 is a schematic view of a fourth embodiment.
Figure 12:
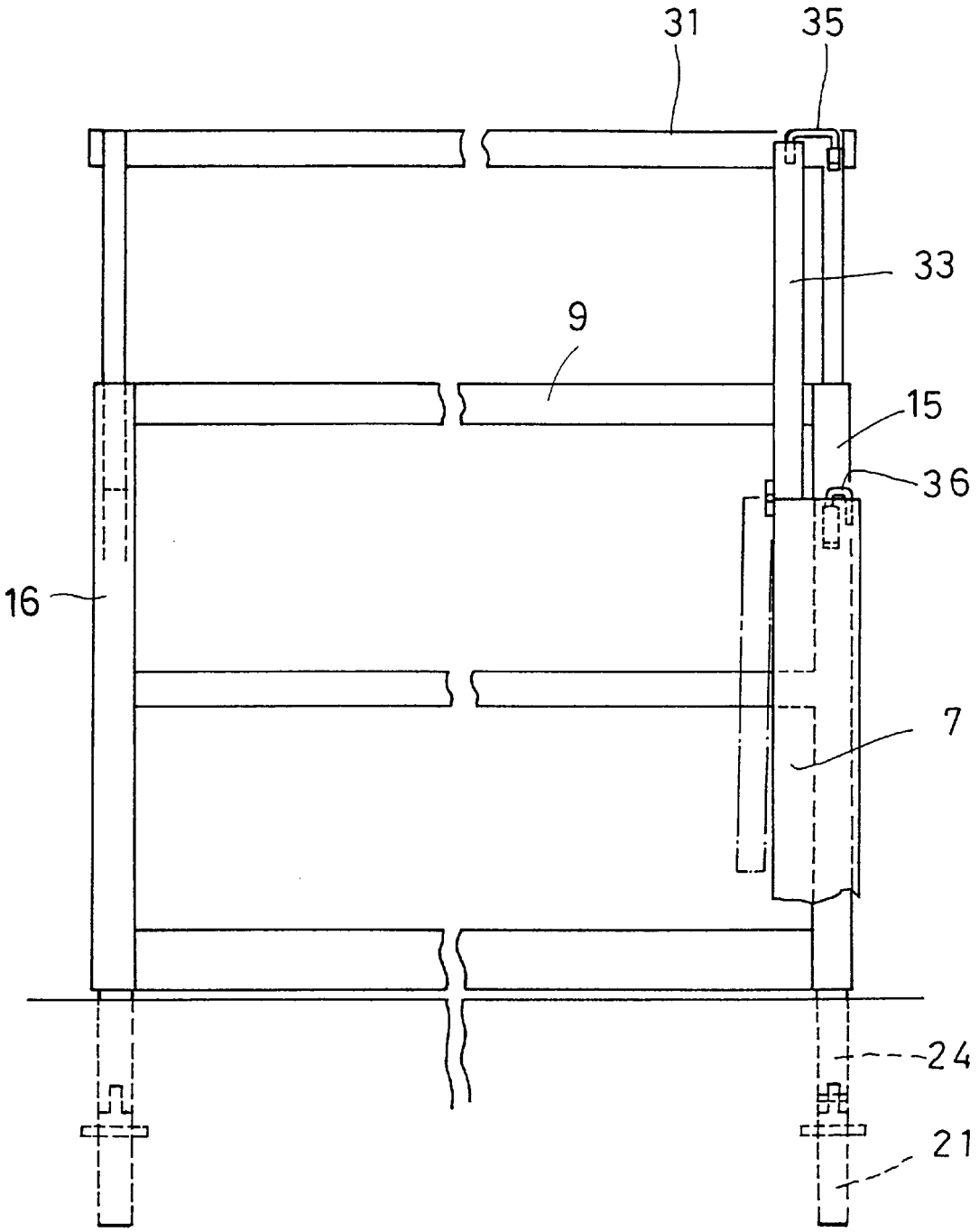
FIG. 12 is a partial enlarged side view of FIG. 11.

In the fourth embodiment shown in FIGS. 11–12, frames are provided on the top of the lids 7 and the side frames 9 to increase the height of the fence.

A sub-frame 33 is mounted on top of each lid 7 by hinges 34. A vertically slidable and fixable slide frame 31 is provided on top of each side frame 9. Each slide frame 31 has slide members 32 vertically slidably inserted in the top ends of the support poles 15 and 16 of the side frame 9. The sub-frames 33 are of such a height that men will not fall into the hatch. The height of the slide frames 31 is adjustable depending on the height of the sub-frames 33. The lid 7 and the side frame 9 are erected and coupled together by coupling 36. The sub-frames 33 and slide frames 31 are erected and coupled together by coupling 35 to fix them together.

The structure of this embodiment (other than the structure specifically described above) is the same as in the first embodiment. Gears mounted to the lids 7 and gear-supporting shafts may be ordinary ones or those used in the first embodiment. If it is necessary to pivot frames 9 toward the slab 1, the support poles 15, 16 of the frames 9 used in the second embodiment may be used. If it is desired to open and close the frame 9, the frame 9 used in the third embodiment may be used.

According to the present invention, since the brackets 10 are provided at both sides of the gears 4, 5, the first and second shafts 3 and 6, respectively, can be provided between the brackets 10. There is no need to provide first and second shafts 3, 6 that extend from one side of the hatch to the other side of the hatch. That is, there is no need to provide shafts that extend between gears provided along one side. Thus, the entire area of the hatch, except the portions where there are gears, is usable.

Since the side frame or frames on one side of the hatch are pivotable away from the hatch 2, i.e., toward the slab 1 to a flat position, articles can be brought in our out without lifting them to a level higher than the top of the safety fence.

Since one of the side frames 9 is openable, an operator can enter the pit by opening the frame.

The height of the lids 7 and the side frames 9 can be increased by adding the sub-frames 33 and the slid frames 31. Thus, even if the hatch 2 is small so that the lids 7 and side frames 9 are low in height, their height can be increased to positively prevent workers from falling into the hatch.

What is claimed is:

1. An apparatus comprising:

a slab having a plurality of support holes;

a rectangular hatch formed in said slab, said hatch having a first pair of opposing sides and a second pair of opposing sides; and a fence surrounding said hatch, said fence including:

a plurality of gear mechanisms at each of said first pair of opposing sides of said hatch, each of said gear mechanisms including: a first gear, a second gear in mesh with said first gear, a first shaft arranged parallel to said first pair of opposing sides and supporting said first gear, a second shaft arranged parallel to said first pair of opposing sides and supporting said second gear, and a counterweight mounted to said second shaft;

a plurality of brackets secured to each of said first pair of opposing sides of said hatch, each of said brackets having a pair of bracket portions supporting said first shaft of one of said gear mechanisms and said second shaft of said one of said gear mechanisms therebetween;

a pair of lids having lower ends connected to said first gear of said gear mechanisms, respectively, such that each of said lids is capable of pivoting between an erect position and a lowered position, each of said lids covering about half of an opening formed by said hatch when said each of said lids is in said lowered position;

a plurality of extensions retained in said support holes of said slab; and a plurality of side frames arranged along said second pair of opposing sides of said hatch and having support poles, each of said support poles having an end connected to one of said extensions by a pivot pin such that each of said support poles is capable of pivoting about said pivot pin, whereby each of said side frames is capable of pivoting between a first lowered position whereat said each of said side frames extends over said hatch, an erect position whereat said support poles are retained in said support holes, and a second lowered position whereat said each of said side frames extends over said slab;

wherein at least one of said support poles comprises a swivel support pole including an upper pole portion having a shaft extending from a lower end thereof and a lower pole portion having a sheath receiving said shaft, said shaft being capable of rotating within said sheath, and wherein at least one of said support poles comprises a latch support pole including an upper pole portion and a lower pole portion, said upper pole portion of said latch support pole being separably connected to said lower pole portion of said latch support pole by a connection pin, and wherein at least one of sad plurality of side frames includes one of said at least one of said support poles comprising a swivel support pole at a first end and includes one of said at least one of said support poles comprising a latch support pole at a second end opposite said first end, and wherein said at least one of said plurality of side frames is capable of pivoting about said swivel support pole between an open position and a closed position by disengaging said connection pin;

wherein said fence is formed by arranging said pair of lids in said erect position and by arranging said plurality of side frames in said erect position.

2. The apparatus of claim 1, wherein when each of said side frames is in said erect position, said each of said side frames has a predetermined height.

3. An apparatus comprising:

a slab;

a rectangular hatch formed in said slab, said hatch having a first pair of opposing sides and a second pair of opposing sides; and a fence surrounding said hatch, said fence including:

a plurality of gear mechanisms at each of said first pair of opposing sides of said hatch, each of said gear mechanisms including: a first gear, a second gear in mesh with said first gear, a first shaft arranged parallel to said first pair of opposing sides and supporting said first gear, a second shaft arranged parallel to said first pair of opposing sides and supporting said second gear, and a counterweight mounted to said second shaft;

a plurality of brackets secured to each of said first pair of opposing sides of said hatch, each of said brackets having a pair of bracket portions supporting said first shaft of one of said gear mechanisms and said second shaft of said one of said gear mechanisms therebetween;

a pair of lids, each of said pair of lids having a lower end and an upper end opposite said lower end, said lower end of each of said pair of lids being connected to said first gear of said gear mechanisms, respectively, such that each of said lids is capable of pivoting between an erect position and a lowered position, each of said lids covering about half of an opening formed by said hatch when said each of said lids is in said lowered position, each of said pair of lids having to said upper end of said lid by a hinge, wherein said sub-frame is capable of pivoting frame fastened between an upper position and a lower position;

a plurality of side frames arranged along said second pair of opposing sides, each of said side frames having an upper end and a lower end opposite said upper end, said lower end of each of said side frames being pivotally connected to said slab such that each of said plurality of side frames is capable of pivoting between a lowered position and an erect position, each of said plurality of side frames having a slide frame slidably connected to said upper end of said side frame, wherein said slide frame is capable of sliding in a vertical direction between an upper position and a lower position; and a coupling mechanism coupling said slide frame of each of said side frames to said sub-frame of one of said lids when said slide frame is in said upper position and said sub-frame is in said upper position;

wherein said fence is formed by arranging said pair of lids in said erect position and by arranging said plurality of side frames in said erect position.

4. The apparatus of claim 3, wherein when each of said side frames is in said erect position, said each of said side frames has a predetermined height.

5. An apparatus comprising:

a slab;

a rectangular hatch formed in said slab, said hatch having a first pair of opposing sides and a second pair of opposing sides; and a fence surrounding said hatch, said fence including:

a pair of lids pivotally connected to said first pair of opposing sides such that each of said lids is capable of pivoting between an erect position and a lowered position, each of said lids covering about half of an opening formed by said hatch when said each of said lids is in said lowered position;

a plurality of side frames arranged along said second pair of opposing sides and pivotally connected to said slab such that each of said side frames is capable of pivoting between a lowered position and an erect position;

at least one swivel support pole including an upper pole portion having a shaft extending from a lower end thereof and a lower pole portion having a sheath receiving said shaft, said shaft being capable of rotating within said sheath; and at least one latch support pole including an upper pole portion and a lower pole portion, said upper pole portion of said latch support pole being separably connected to said lower pole portion of said latch support pole by a connection pin;

wherein at least one of said plurality of side frames includes one of said at least one swivel support pole at a first end and includes one of said at least one latch support pole at a second end opposite said first end, and wherein said at least one of said plurality of side frames is capable of pivoting about said swivel support pole between an open position and a closed position by disengaging said connection pin;

wherein said fence is formed by arranging said pair of lids in said erect position and by arranging said plurality of side frames in said erect position.

6. The apparatus of claim 5, wherein when each of said side frames is in said erect position, said each of said side frames has a predetermined height.

7. An apparatus comprising:

a slab;

a rectangular hatch formed in said slab, said hatch having a first pair of opposing sides and a second pair of opposing sides; and a fence surrounding said hatch, said fence including:

a pair of lids, each of said lids having an upper end and a lower end opposite said upper end, said lower end of each of said pair of lids being pivotally connected to said first pair of opposing sides such that each of said lids is capable of pivoting between an erect position and a lowered position, each of said lids covering about half of an opening formed by said hatch when said each of said lids is in said lowered position, each of said pair of lids having a sub-frame fastened to said upper end of said lid by a hinge, wherein said sub-frame is capable of pivoting about said hinge between an upper position and a lower position;

a plurality of side frames arranged along said second pair of opposing sides, each of said plurality of side frames having an upper end and a lower end opposite said upper end, said lower end of each of said side frames being pivotally connected to said slab such that each of said side frames is capable of pivoting between a lowered position and an erect position, each of said plurality of side frames having a slide frame slidably connected to said upper end of said side frame, wherein said slide frame is capable of sliding in a vertical direction between an upper position and a lower position;

wherein said fence is formed by arranging said pair of lids in said erect position and by arranging said plurality of side frames in said erect position.

8. The apparatus of claim 7, further comprising a coupling mechanism coupling said slide frame of each of said side frames to said sub-frame of one of said lids when said slide frame is in said upper position and said sub-frame is in said upper position.

9. The apparatus of claim 7, wherein when each of said side frames is in said erect position, said each of said side frames has a predetermined height.

10. An apparatus comprising:

a slab;

a rectangular hatch formed in said slab, said hatch having a first pair of opposing sides and a second pair of opposing sides; and a fence surrounding said hatch, said fence including:

a plurality of gear mechanisms at each of said first pair of opposing sides of said hatch, each of said gear mechanisms including: a first gear, a second gear in mesh with said first gear, a discrete first shaft arranged parallel to said first pair of opposing sides and supporting said first gear, a discrete second shaft arranged parallel to said first pair of opposing sides and supporting said second gear, and a counter-weight mounted to said second shaft;

a plurality of brackets secured to each of said first pair of opposing sides of said hatch, each of said brackets having a pair of bracket portions supporting said discrete first shaft of one of said gear mechanisms and said discrete second shaft of said one of said gear mechanisms therebetween;

a pair of lids having lower ends connected to said first gear of said gear mechanisms such that each of said lids is capable of pivoting between an erect position and a lowered position, each of said lids covering about half of an opening formed by said hatch when said each of said lids is in said lowered position; and a plurality of side frames arranged along said second pair of opposing sides, each of said side frames having an upper end and a lower end opposite said upper end, said lower end of each of said side frames being pivotally connected to said slab such that each of said plurality of side frames is capable of pivoting between a lowered position and an erect position;

wherein said fence is formed by arranging said pair of lids in said erect position and by arranging said plurality of side frames in said erect position.

11. The apparatus of claim 10, wherein said slab has a plurality of support holes, further comprising a plurality of extensions retained in said support holes of said slab, each of said side frames having support poles, each of said support poles having an end connected to one of said extensions by a pivot pin such that each of said support poles is capable of pivoting about said pivot pin, each of said side frames being capable of pivoting between a first lowered position whereat said each of said side frames extends over said hatch, a erect position whereat said support poles are retained in said support holes, and a second lowered position whereat said each of said side frames extends over said slab.

12. The apparatus of claim 10, wherein when each of said side frames is in said erect position, said each of said side frames has a predetermined height.

13. An apparatus comprising:

a slab having a plurality of support holes;

a rectangular hatch formed in said slab, said hatch having a first pair of opposing sides and a second pair of opposing sides, wherein said support holes are arranged along said second pair of opposing sides; and a fence surrounding said hatch, said fence including:

a pair of lids pivotally connected to said first pair of opposing sides;

a plurality of extensions slidably retained in said support holes of said slab; and a plurality of side frames arranged along said second pair of opposing sides of said hatch, each of said side frames having support poles, each of said support poles having an end pivotally connected to one of said extensions by a pivot pin;

wherein each of said extensions is capable of sliding within one of said support holes between a first position whereat said pivot pin is outside of said one of said support holes, and a second position whereat said pivot pin is within said one of said support holes.

14. The apparatus of claim 13, wherein each of said pair of lids has an upper end and a sub-frame fastened to said upper end of each of said lids by a hinge, wherein said sub-frame is capable of pivoting about said hinge between an upper position and a lower position; and wherein each of said plurality of side frames has an upper end and a slide frame slidably connected to said upper end of said side frame, wherein said slide frame is capable of sliding in a vertical direction between an upper position and a lower position; and further comprising a coupling mechanism coupling said slide frame of each of said side frames to said sub-frame of one of said lids when said slide frame is in said upper position and said sub-frame is in said upper position.

* * * * *